US005676529A

United States Patent [19]

Hermansen et al.

[11] Patent Number: 5,676,529

[45] Date of Patent: Oct. 14, 1997

[54] COMPACT MANUAL AIR PUMP HAVING SELECTABLE HIGH VOLUME AND HIGH PRESSURE MODES

[76] Inventors: Frank Hermansen; Carl Winefordner, both of 548 Seaward Rd., Corona Del Mar, Calif. 92625

[21] Appl. No.: 680,749

[22] Filed: Jul. 15, 1996

[51] Int. Cl.[6] ..... F04B 25/02

[52] U.S. Cl. ..... 417/259

[58] Field of Search ..... 417/251, 252, 417/258, 259, 238, 468, 523, 528

[56] References Cited

U.S. PATENT DOCUMENTS

| | | | |
|---|---|---|---|
| 753,530 | 3/1904 | Eyck . | |
| 817,538 | 4/1906 | Wixon | 417/258 |
| 1,149,324 | 8/1915 | Baldwin et al. . | |
| 1,187,835 | 6/1916 | Hill | 417/258 |
| 1,412,279 | 4/1922 | Eslinger . | |
| 1,424,928 | 8/1922 | McClelland | 417/258 |
| 3,302,535 | 2/1967 | Procter et al. . | |
| 4,508,490 | 4/1985 | Ramirez et al. | 417/234 |
| 5,051,073 | 9/1991 | Newbold . | |
| 5,165,876 | 11/1992 | Wang | 417/511 |
| 5,443,370 | 8/1995 | Wang | 417/238 |

*Primary Examiner*—Richard E. Gluck
*Attorney, Agent, or Firm*—Leonard Tachner

[57] ABSTRACT

A pump comprises a pair of coaxial pistons, one slidably positioned in the other for simultaneous compression causing oppositely directed air flow, a passage having a valve for permitting air flow from one such piston to enter the other such piston for increased air flow, and a switching device for selectively opening the passage to ambient for preventing air flow between the pistons. The pump thus has two modes, namely, a high volume mode when the two pistons operate simultaneously to direct combined air flow and a high pressure mode when the passage is opened to ambient to direct air flow from only one of the two pistons having a smaller bore.

8 Claims, 6 Drawing Sheets

COMPACT MANUAL AIR PUMP HAVING SELECTABLE HIGH VOLUME AND HIGH PRESSURE MODES

BACKGROUND OF THE INVENTION

1. Field of the Invention

The invention relates to a compact dual-mode manual pump such as for inflating bicycle tires and that in one mode provides a very high volume of air per pump stroke and in another mode provides less volume per stroke but enables the user to inflate to higher pressures.

2. Prior Art

Bicycle pumps are typically made in two varieties: 1) Big bore for high volume per stroke and low pressures (up to about 50 psi generally used for tires with large cross-sectional diameters such as tires for mountain bikes); and 2) small bore for low volume per stroke and high pressure (up to about 120 psi generally used for tires with smaller cross-sectional diameters such as tires for road bikes).

The weight and size of objects carried with the bicyclist affects the amount of work required to propel the bicycle. Greater weight increases rolling resistance, reduces acceleration, and increases the work to ascend hills. Greater size can increase wind resistance and is a greater problem to carry. A pump is an item that many bicycling enthusiasts consider essential to carry in case of a flat tire and they prefer to carry the most size and weight efficient pump possible. One way to measure efficiency is by comparing the volume of air pumped per stroke to the overall size of the closed pump.

In an attempt to increase the volume per stroke in portable hand pumps, some pumps are telescoping; that is they have a sliding chamber and piston within a sliding chamber and piston. Unfortunately, this also increases the stroke length excessively and does nothing to allow a selection between pumping air to low pressures at high volume per stroke and high pressures with low volume per stroke. Another attempt to increase the volume per stroke is a double action pump; that is the pump pushes air into the tire on both the push and pull motion of the stroke. One problem with this is that people do not have the same physical strength in the pushing and pulling motions. People are generally stronger pushing. The pressure that can be reached is limited by the pulling strength. Therefore a pump of a given diameter cannot achieve as high a pressure as a single action pump. Secondly, as with the telescoping pump, it is fixed at a given volume per stroke. Lastly, many people do not like to use a double action pump because they find it uncomfortable to use.

Generally when pumping a tire to say, 100 psi with a bicycle pump, the effort per stroke required starts at near zero and ends at a relatively high level. When the tire is empty or at low pressure, there is very little force required to push air into it. As the pressure in the tire increases, the force increases in direct proportion. The force is equal to the pressure times the piston area (neglecting a small amount of friction).

It is frustrating to pump up a high pressure tire with a small bore pump because the first phase of inflation requires little force but many strokes. In fact, it takes over 200 strokes of some pumps to inflate a road bike tire to 100 psi (and over 400 strokes to inflate a mountain bike tire to 50 psi) and the first 100 strokes feel as if nothing is happening because the force exerted is so small. Even though the energy per stroke is small, this repeated motion is still tiring. Imagine for a moment rapidly waving your arms together and apart 100 times. No real work was accomplished but you will still feel exertion. It also takes time (which is especially important for cycling competitors). As the bore of the pump piston is increased in size, the volume per stroke increases as does the force required. For example, a pump with a piston diameter of 0.5" requires about 20 pounds of force to generate 100 psi. A pump diameter of 1.0" requires about 80 pounds of force to generate 100 psi, but pushes four times the volume of air per stroke. Most people are not strong enough to push a pump with 80 pounds of force repeatedly so high pressure pumps have small piston bore diameters and people are forced to accept that they will have to pump many easy strokes to inflate the tire to half of the desired pressure before incurring any significant resistance.

The following are patents which are considered relevant to the invention:

U.S. Pat. No. 753,530 Ten Eyck
U.S. Pat. No. 1,149,324 Baldwin et al
U.S. Pat. No. 1,412,279 Eslinger
U.S. Pat. No. 3,302,535 Procter et al
U.S. Pat. No. 4,508,490 Ramirez et al
U.S. Pat. No. 5,051,073 Newbold
U.S. Pat. No. 5,165,876 Wang
U.S. Pat. No. 5,443,370 Wang Of particular interest is U.S. Pat. No. 5,443,370 to Wang, which discloses a two cylinder telescoping air pump which pumps high volumes at low pressure when fully extended, and low volumes at high pressure when partially collapsed which is a short stroke configuration. Furthermore, the U.S. Pat. No. 4,508,490 to Ramirez et al, discloses a two stage manual air pump which can pump either high volumes at low pressure, or low volumes at high pressure. However, this pump is a very bulky and complex structure and is actually two distinct pumps mounted coaxially for very low pressures. In addition, U.S. Pat. No. 1,149,324 to Baldwin et al, discloses a cylindrical double-acting, compound air pump. The remainder of the above-listed patents were selected to further illustrate patents in the field of manual air pumps.

It would be desirable to have a pump that can pump a high volume of air per stroke for relatively low pressures and then be adjusted so as to pump a small volume of air per stroke for relatively high pressures. It would also be desirable if the adjustment from the high to low volume per stroke was simple. It would also be desirable if the pump, in its high volume mode, pumps a relatively high volume without increasing the stroke length substantially (as in the case with telescoping pumps). It would also be desirable to have a pump that can pump relatively large volumes of air per stroke for its overall size.

SUMMARY OF THE INVENTION

In the present invention, when inflating a tire, the user pumps using the high volume setting until either the desired pressure is reached or the effort becomes too high for that particular person. Then he or she switches the setting to low volume which causes the effort to decrease dramatically and he or she can continue to pump the tire up to the desired pressure. This results in an overall decrease in strokes and time to fill the tire without requiring excessive force.

In an alternative embodiment without the feature of being able to switch between low volume and high volume modes, this pump is advantageous because it produces an extremely high volume of air per stroke for its overall size.

This invention can be easily applied to a floor pump. Floor pumps are generally free standing pumps with a flexible hose used to inflate tires quickly. Floor pumps generally have larger diameters than portable pumps because the user can apply his or her body weight to the handle so they are able to achieve a relatively high pressure even with a large diameter piston. The problem is, however, that relatively light or weak individuals may not be able to achieve a high pressure, say 120 or 140 psi, using a floor pump. It is advantageous in a floor pump to be able to switch to a low volume/high pressure mode after they can no longer easily continue pumping yet need to achieve a higher pressure.

The dual mode air pump of the present invention, in a preferred mode, comprises outer, middle and inner concentric tubes selectably interconnected for air flow therebetween by an end cap, the threaded position of which determines the mode of pump operation, i.e., high volume or high pressure. In the high volume mode, the end cap is closed and air from both the outer tube and middle tube is pushed simultaneously by the pump action. The inner tube provides a flow passage between the outer tube and the middle tube. In the high pressure mode, the end cap is opened and air from the outer tube exits through the loosened cap. The pumping action pushes air only out of the middle tube which, because of its reduced diameter, incurs lower resistance for any given tire pressure as compared to the combination of the larger diameter outer tube and the middle tube. Various valves, O-rings and seals, assure proper air flow direction in both modes. Other embodiments disclosed herein include a pump permanently configured for high volume and a dual mode floor pump.

OBJECTS OF THE INVENTION

It is therefore a principal object of the invention to provide a compact, dual-mode hand pump having a selectable high volume mode and a selectable high pressure mode and which is not substantially different in size or shape from conventional bicycle pumps.

It is another object of the invention to provide a compact manual pump having a switching device to select either of two modes of operation, one such mode being high volume and the other such mode being high pressure.

It is still another object of the invention to provide a compact, hand pump which pumps a high volume of air with each stroke.

It is still an additional object of the invention to provide a dual mode manual floor pump with selectable switching between a high volume low pressure mode and a low volume high pressure mode.

BRIEF DESCRIPTION OF THE DRAWINGS

The aforementioned objects and advantages of the present invention, as well as additional objects and advantages thereof will be more fully understood hereinafter, as a result of a detailed description of preferred embodiments thereof, when taken in conjunction with the following drawings in which.

DETAILED DESCRIPTION OF PREFERRED EMBODIMENTS

Figure 1:
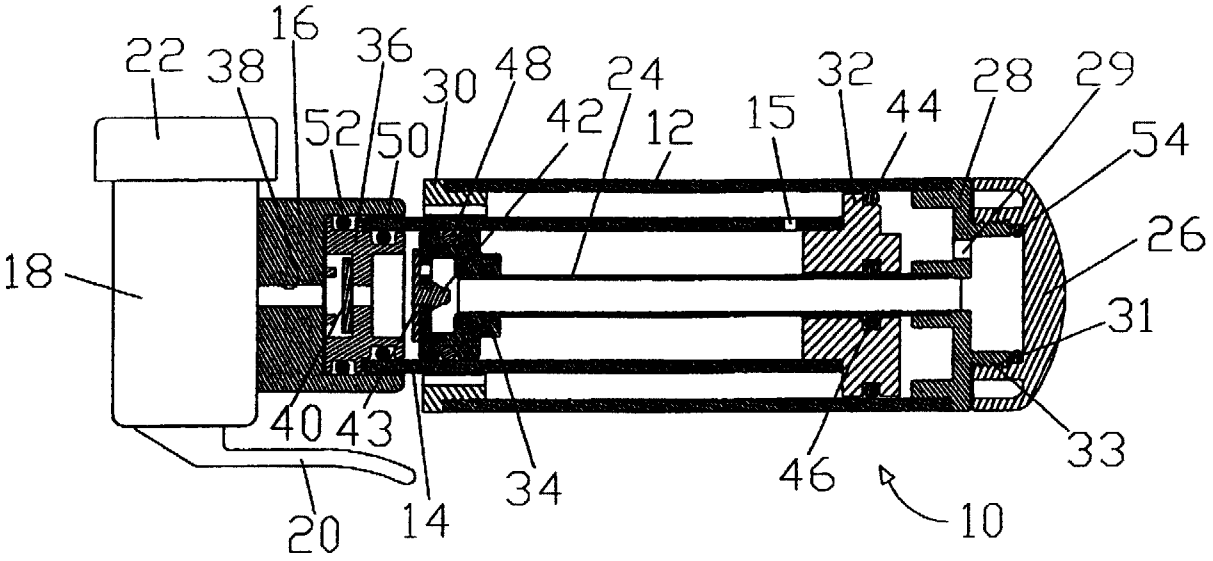
FIG. 1 is a partially cross-sectioned view of a preferred embodiment of the invention shown configured for high volume/low pressure pumping and in a fully collapsed condition.

The preferred embodiment of the present invention may be understood by referring to FIGS. 1–8. It will be seen that a dual mode air pump 10 comprises an outer cylindrical tube 12, a middle cylindrical tube 14 and an inner cylindrical tube 24. An end cap 26 provides a selectable interface at one end of both the tubes 12 and 24 so that air can pass between those tubes and eventually into tube 14 as will be described hereinafter. Tube 14 is connected to a pump head 16 comprising a valve 36 having a valve flap 40 and a passage 38. Head 16 is, in turn, integral to a conventional valve interface 18 having a lever 20 and retainer 22 for attachment to a bicycle tube valve or the like in a well-known manner.

Outer tube 12 has a first end seal 28 and a bushing 30. Middle tube 14 has a first end seal 32 and a second end seal 34. Seal 34 has a valve stem 42 and a valve flap 43 adjacent an end of inner tube 24 to permit air flow through tube 24 in only one direction toward valve interface 18. The other end of tube 24 passes through outer tube end seal 28 and terminates adjacent the end cap 26.

It will be observed that seal 32 serves as a piston for the outer tube 12 while seal 34 acts as a piston for middle tube 14. Thus, upon each compression of the pump, two separate pistons and corresponding tubes or cylinders are delivering air simultaneously to pump head passage 38.

Other structural features of the pump 10 include an air hole 15 in tube 14 adjacent seal 32, an air hole 29 through seal 28, seal thread 31 and cap thread 33 to selectively secure end cap 26, and a plurality of O-rings 44, 46, 48, 50, 52 and 54 to provide proper sealing during pump operation.

The described structure of pump 10 forms five distinct air chambers which will be referred to hereinafter to help explain the operation of the preferred embodiment. More specifically, a first air chamber 60 is formed within tube 14 between end seals 34 and pump head valve 36. A second air chamber 62 is formed between tubes 14 and 24 and between seals 32 and 34. A third air chamber 64 is formed between tubes 12 and 14 and between seals 30 and 32. A fourth air chamber 66 is formed between tubes 12 and 24 and between seals 28 and 32. A fifth air chamber 68 is formed between seal 28 and end cap 26 within the perimeter of seal thread 31. The operation of pump 10 will now be described in conjunction with FIGS. 1–8.

High volume/low pressure mode: In this mode, the end cap 26 is screwed shut which seals the end from ambient pressure. In this mode, air within both the outer tube 12 and inner tube 24 is pushed into the pump head 16 which goes into the tire. Notice that the tubes work simultaneously to propel air into passage 38.

Figure 2:
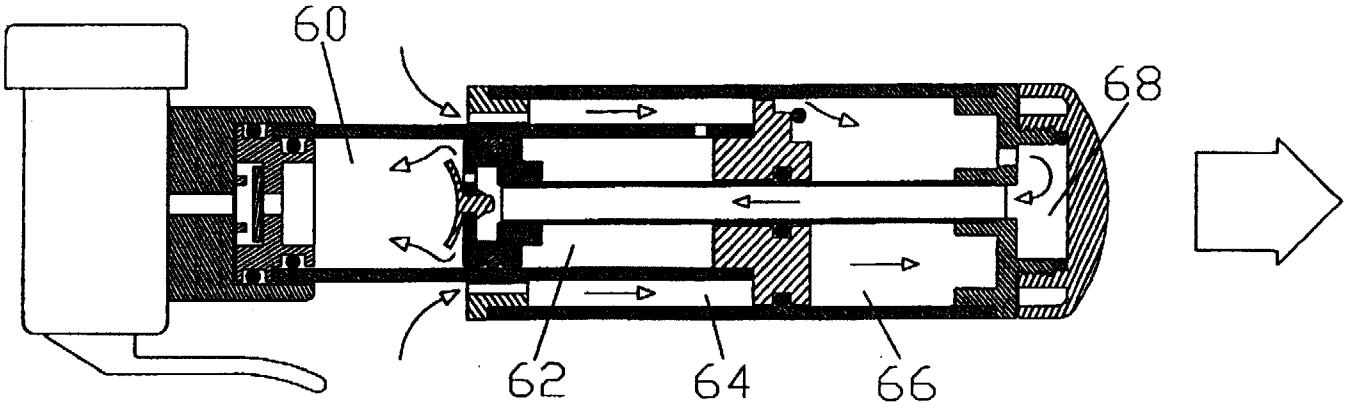
FIG. 2 is a view similar to FIG. 1 but illustrating the invention in transition toward full extension.

In FIG. 1, the pump 10 is closed. In FIG. 2, the pump 10 is being pulled open. The pump head one way valve 36 is closed. The O-ring 44 on the seal slides partially over a corner to allow air to enter the air chamber 66 from ambient. Air fills the chamber 60 by the vacuum opening the one-way valve flap 43 in the end of seal 34 which sucks air from down the hollow tube 24 which connects to the outer tube 12 via the end cap air chamber 68. All of the air that fills the air chamber 60 comes from ambient through the air chambers 64 and 66. Air is pushed out of chamber 62 through hole 15 into the ambient chamber 64. Note that chamber 64 must empty and fill to ambient as the pump is opened and closed.

Figure 3:
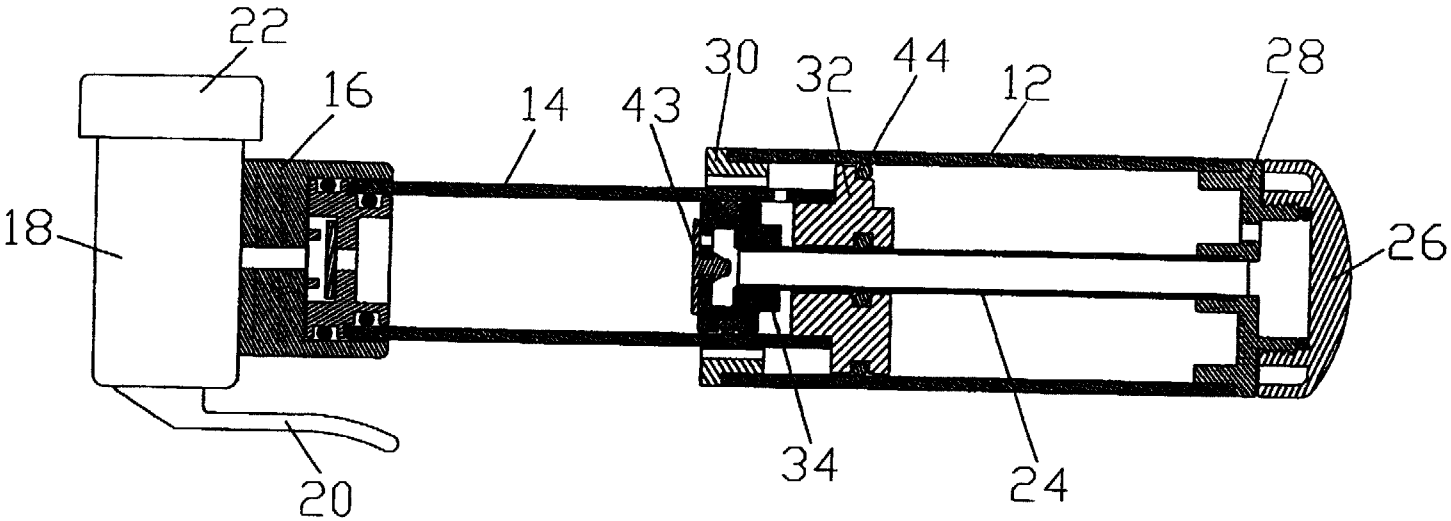
FIG. 3 is a view similar to FIG. 1 but illustrating the invention at full extension.

In FIG. 3, the pump is fully open. The one way valve 36 in the seal 34 at the end of tube 24 is closed and O-ring 44 on the seal 32 moves back to its nominal position.

Figure 4:
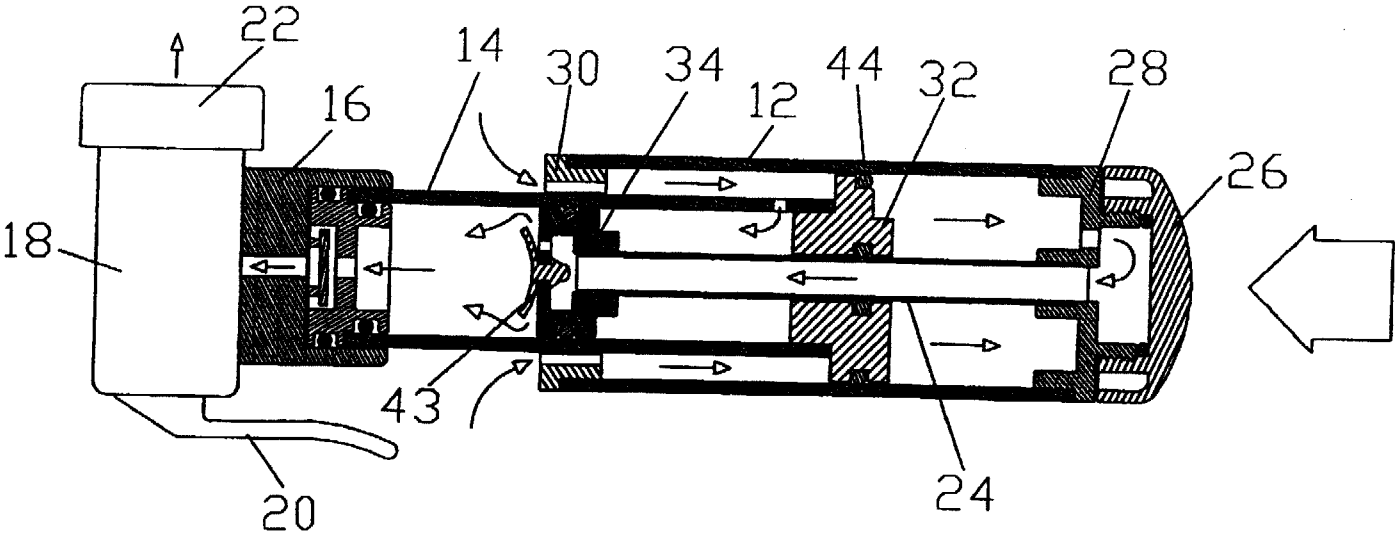
FIG. 4 is a view similar to FIG. 1 but illustrating the invention in transition toward its collapsed condition.

In FIG. 4, the pump is being pushed closed. Air from the air chamber 66 is being forced into the end cap chamber 68 and then down the inner tube 24 past one way valve 43 and into the air chamber 60. Air in chamber 60 is pushed past the pump head one way valve 36 and into the tire. Air is sucked into the chamber 62 through hole 15 in the wall of the small cylinder from the ambient air chamber 64. It will be observed that in this high volume mode the one-way valve 43 serves no purpose, but does hinder operation of the pump.

Low volume/high pressure mode: In this mode, the end cap 26 is loosened which opens the end of pump 10 to ambient pressure. In this mode, air within the outer tube 12 is pushed into the end cap 26 and chamber 68 and out to ambient. Basically, the outer tube no longer pumps air into the tire but instead pushes the air into ambient. The middle tube pushes air into the pump head which goes into the tire. Notice that, effectively, the pump is now a small bore diameter pump capable of higher pressures for the same force input.

Figure 5:
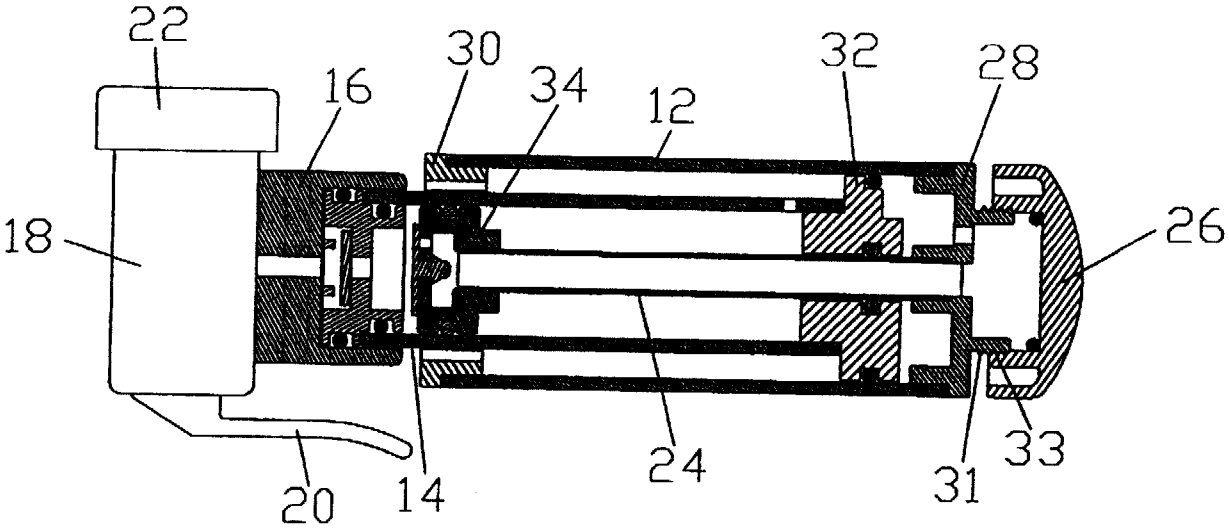
FIG. 5 is a partially cross-sectioned view of the preferred embodiment shown configured for low volume/high pressure pumping and in a fully collapsed condition.
Figure 6:
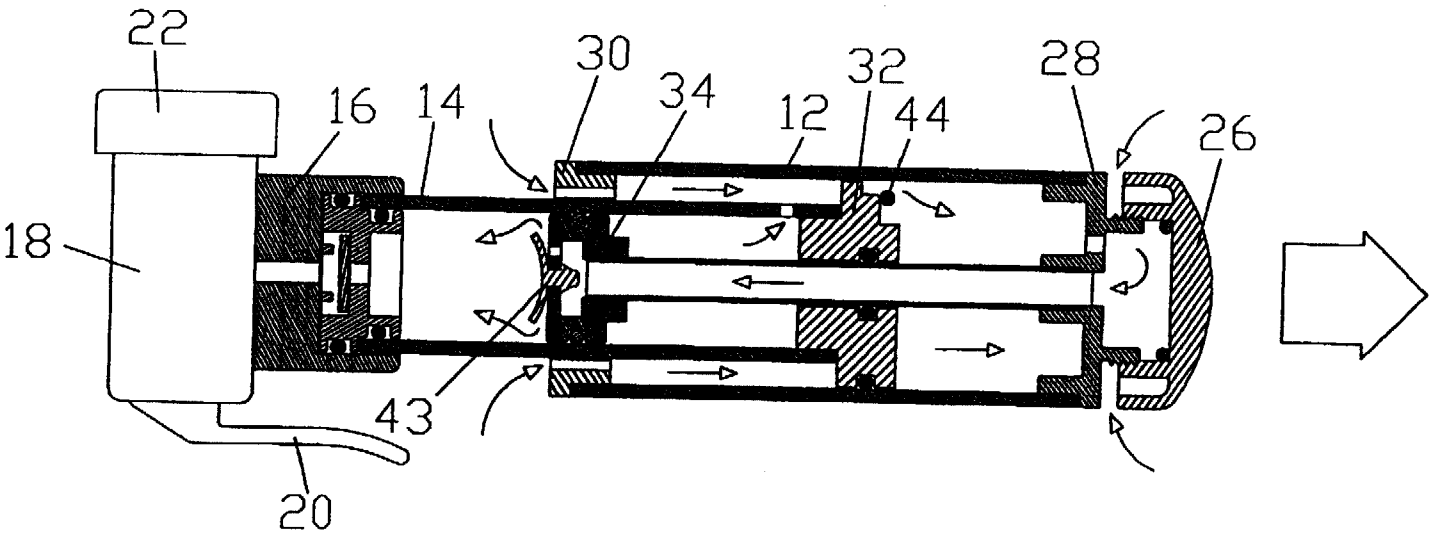
FIG. 6 is a view similar to FIG. 5 but illustrating the invention in transition toward full extension.

In FIG. 5, the pump is closed. In FIG. 6, the pump is being pulled open. The pump head one way valve 36 is closed. Air fills the air chamber 66 from the end cap chamber 68 which is exposed to ambient because the end cap 26 is loosened and/or air fills the chamber 66 from ambient chamber 64 by the O-ring 44 sliding partially over a corner of seal 32. Air fills the chamber 60 by vacuum opening the one way valve 43 in the end of the inner tube 24 which sucks air from down the hollow center of tube 24 from ambient through the end cap chamber 68. Air is pushed out of chamber 62 through hole 15 in the wall of the middle tube 14 into ambient chamber 64.

Figure 7:
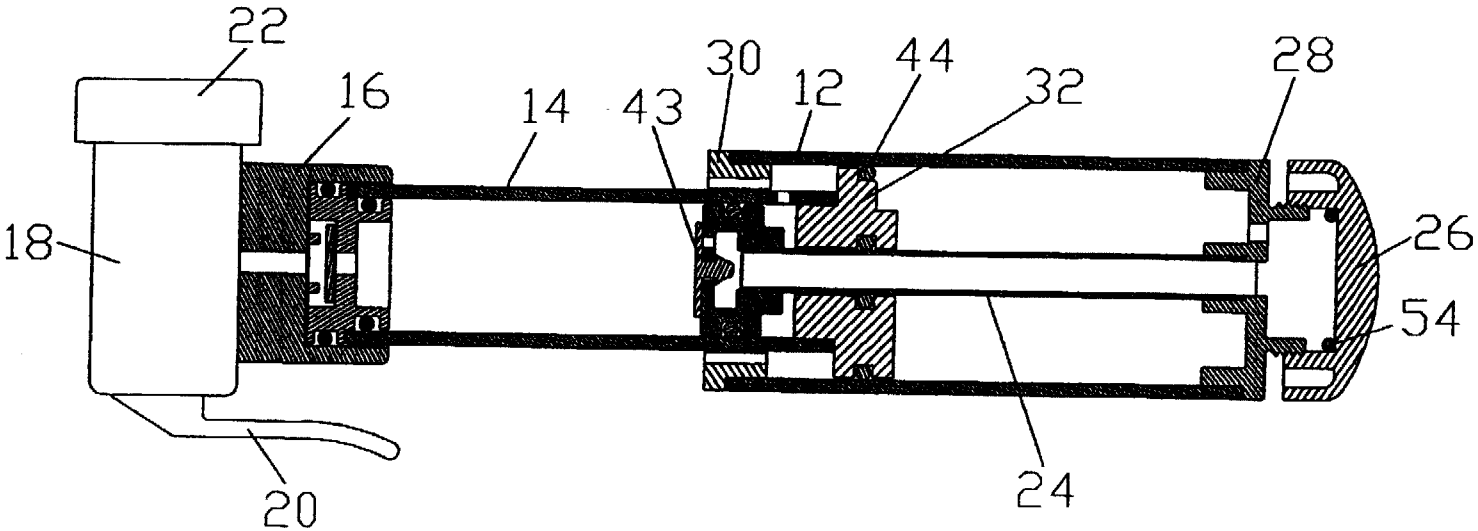
FIG. 7 is a view similar to FIG. 5 but illustrating the invention at full extension.
Figure 8:
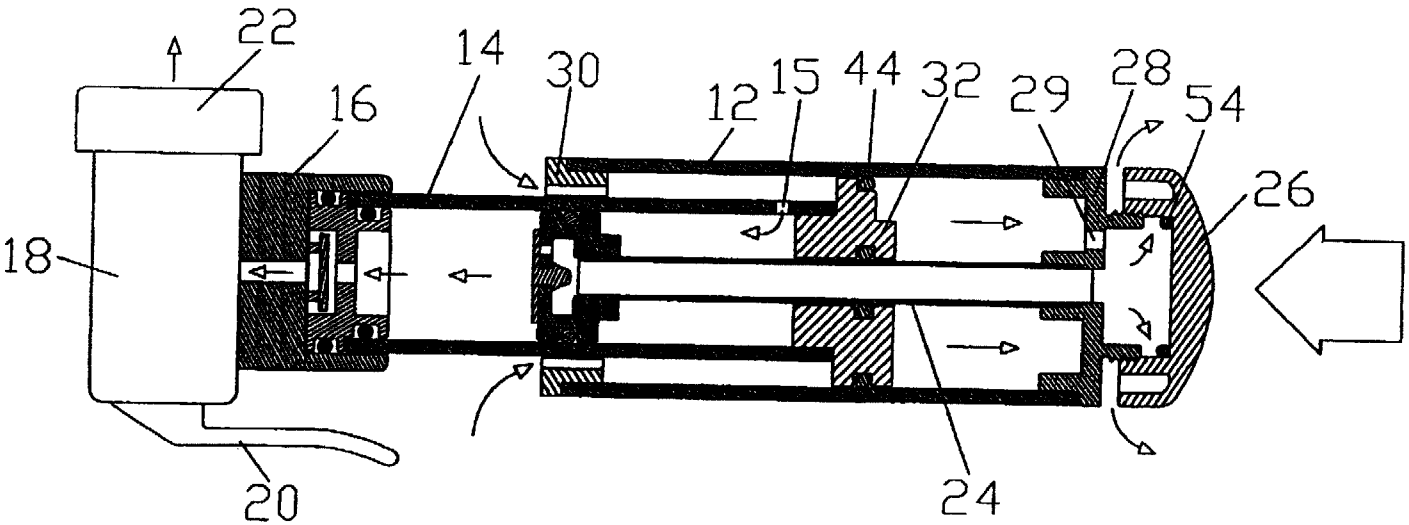
FIG. 8 is a view similar to FIG. 5 but illustrating the invention in transition toward its collapsed condition.

In FIG. 7, the pump is fully open. The one way valve 43 closes and the O-ring 44 moves back into its nominal position. In FIG. 8, the pump is being pushed closed. Air from the chamber 66 is being forced into the end cap chamber 68 and out to ambient. Air in the chamber 60 is pushed past the pump head one way valve 36 and into the tire. Air is sucked into chamber 62 through hole 15 in the wall of tube 14 from the ambient chamber 64. In this high pressure mode, one-way valve 43 is needed to prevent air from middle tube 14 escaping through inner tube 24 and opened end cap 26.

Figure 9:
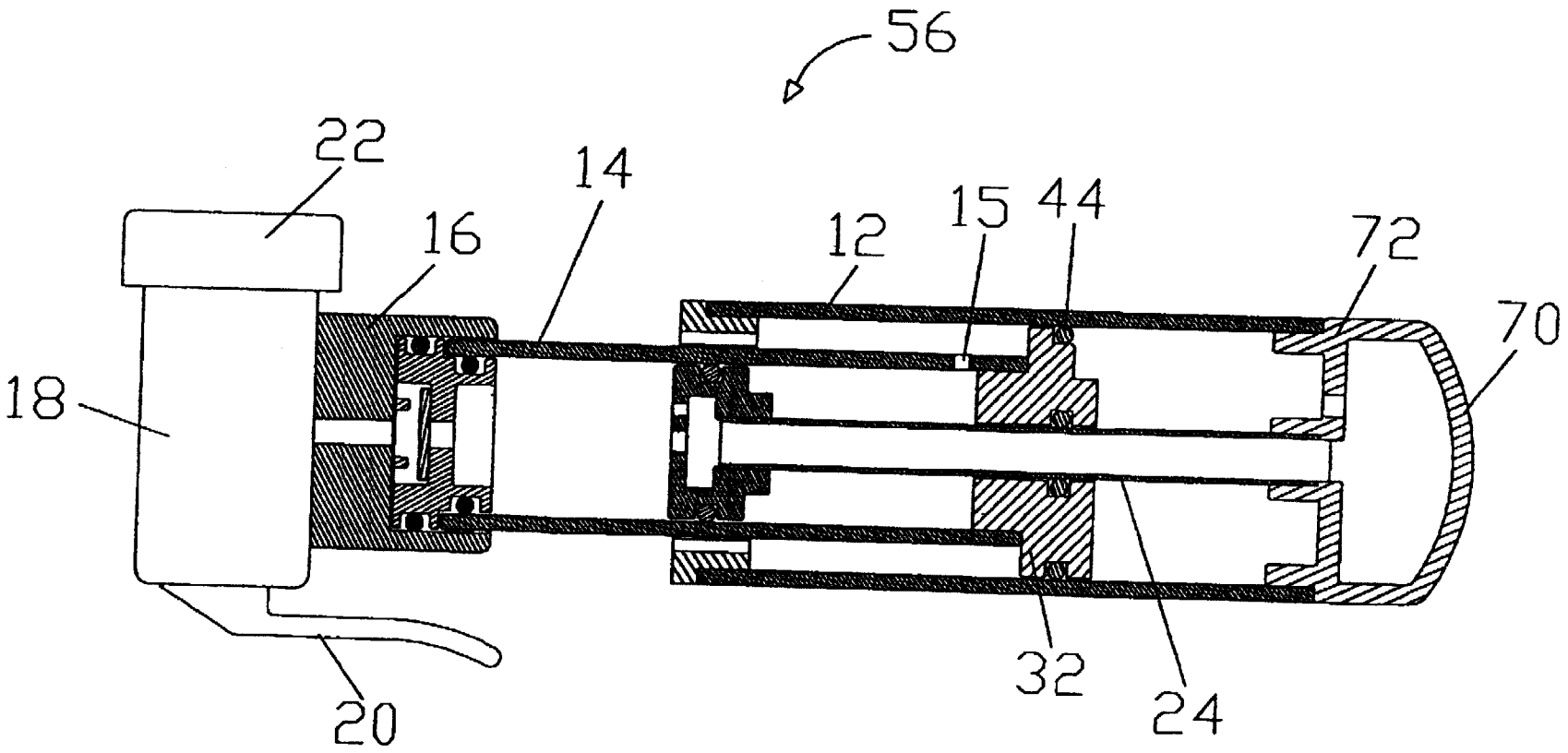
FIG. 9 is a partially cross-sectioned alternative embodiment of the invention which is permanently configured as a high volume pump.

The embodiment 56 of FIG. 9 is virtually identical to the embodiment of FIGS. 1–8 except that end cap 70 is made as an integral part of seal 72 rendering seal thread 31 and cap thread 33 of FIGS. 1–8 unnecessary. Also, valve 43 is unnecessary and is omitted. As a result, the embodiment of FIG. 9 is permanently in the high volume configuration equal to the configuration of FIGS. 1–4. An embodiment of the configuration of FIG. 9 may be advantageous for users who prefer or need only high volume air pumping in a relatively compact configuration.

Figure 10:
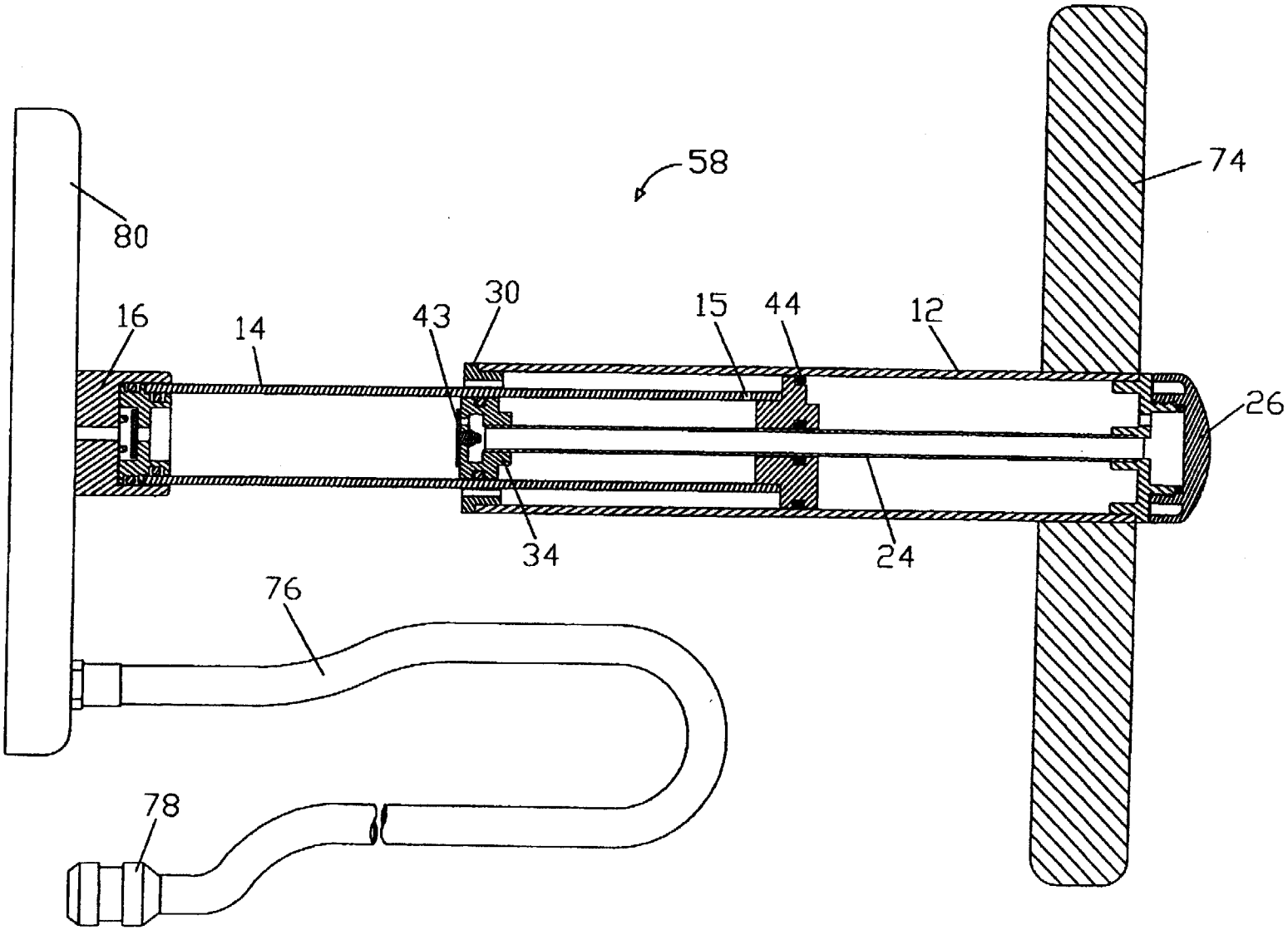
FIG. 10 is a partially cross-sectioned additional alternative embodiment of the invention which is configured as a dual mode floor pump.

The embodiment 58 of FIG. 10 is also virtually identical to the embodiment of FIGS. 1–8, but is altered to the configuration of a floor pump. The operation of pump 58 is in all respects identical to that of hand pump 10. A handle 74 and a hose 76 and valve attachment 78 connected through a floor support base 80 are added.

It will now be understood that the present invention comprises a novel dual mode air pump in which three distinct air tubes and a threadably connected end cap provide a user with two pumping options which may be selected at any time. One such option is high volume and low pressure and the other option is high pressure and low volume. The threaded position of the end cap (i.e., tightened to air-tight or loosened to non-airtight) determines which of the two options is selected.

Those having ordinary skill in the art of air pumps will now, as a result of the disclosure herein, conceive various additions and modifications which may be made to the invention. By way of example, other devices for switching between modes may be used such as a device for limiting rotation of the end cap or a rocker arm that may or may not block a flow passage to ambient. In addition one may readily conceive of an automatic switch device which selects the high pressure mode at a preselected pressure (eg: 60 psi) after a nominal selection of the high volume mode at lower pressures. Also, it will be understood that the relative dimensions of the two pistons or tubes may be readily altered to provide different degrees of relative change between the two modes. Accordingly, all such additions and modifications are deemed to be within the scope of the invention which is to be limited only by the appended claims and their equivalents.

We claim:

1. A manually operated air pump of the type terminating in a valve for connection to a device to be inflated and comprising:

an outer tube selectively closed at one end;

an inner tube concentrically positioned within said outer tube and communicating with said closed one end of said outer tube;

a middle tube positioned between said outer and inner tubes and moveable coaxially relative to said outer and inner tubes;

a first seal at an end of said middle tube forming a moveable piston within said outer tube for driving air toward said closed one end;

a second seal at an end of said inner tube forming a moveable piston within said middle tube for driving air toward said valve, said second seal having a one way valve;

said closed one end of said outer tube forming a chamber for redirecting air from said outer tube into said inner tube, through said one-way valve and into said middle tube;

a device for selectively closing and opening said one end of said outer tube for either sealing or unsealing said chamber for corresponding high volume or high pressure operation of said pump.

2. The air pump recited in claim 1 wherein said device comprises a threaded end cap for selectively closing and opening said one end of said outer tube.

3. The air pump recited in claim 1 wherein upon compression of said pump, air from both said outer tube and said middle tube is driven into said device to be inflated.

4. The air pump recited in claim 1 further comprising a floor base on said terminating valve and a handle on said outer tube for configuring said pump as a floor pump.

5. A manual air pump comprising:

a pair of coaxial cylinders, one slidably positioned in the other for simultaneous compression causing oppositely directed air flow therein;

a passage having a valve for permitting air from one such cylinder to enter the other such cylinder for increased air flow; and a switching device for selectively opening said passage to ambient for preventing air from said one such cylinder from entering the other such cylinder.

6. The air pump recited in claim 5 wherein said device for opening said passage comprises a threaded end cap positioned at one end of an outer one of said cylinders.

7. The air pump recited in claim 5 wherein said passage comprises a tube coaxially positioned within said cylinders.

8. The air pump recited in claim 5 further comprising a floor base and a handle for configuring said pump as a floor pump.

* * * * *